US010395492B1

(12) United States Patent
Thompson

(10) Patent No.: US 10,395,492 B1
(45) Date of Patent: Aug. 27, 2019

(54) SPEED-OF-SOUND EXHIBIT

(71) Applicant: Kelvin Thompson, Austin, TX (US)

(72) Inventor: Kelvin Thompson, Austin, TX (US)

( * ) Notice: Subject to any disclaimer, the term of this patent is extended or adjusted under 35 U.S.C. 154(b) by 0 days.

(21) Appl. No.: 15/975,310

(22) Filed: May 9, 2018

(51) Int. Cl.
*G08B 7/06* (2006.01)
*H05B 37/02* (2006.01)

(52) U.S. Cl.
CPC ..... *G08B 7/06* (2013.01); *H05B 37/029* (2013.01); *H05B 37/0227* (2013.01)

(58) Field of Classification Search
None
See application file for complete search history.

(56) References Cited

U.S. PATENT DOCUMENTS 5,461,188 A * 10/1995 Drago ..... A43B 3/00 36/137
6,935,760 B2 * 8/2005 Bar-Cohen ..... B05B 17/0607 239/102.2
8,546,674 B2 * 10/2013 Kurihara ..... H04R 29/008 84/464 R
9,076,328 B2 * 7/2015 Kondo ..... G08G 1/005
2005/0275626 A1 * 12/2005 Mueller ..... H05B 37/0245 345/156
2006/0236845 A1 * 10/2006 Kilkis ..... G10H 1/0075 84/600

* cited by examiner

*Primary Examiner* — John F Mortell
(74) *Attorney, Agent, or Firm* — Meyertons, Hood, Kivlin, Kowert & Goetzel, P.C.; Mark R. DeLuca

(57) ABSTRACT

A system for presenting a demonstration of the speed of sound, includes a sound source that produces a sound wave; a viewing area positioned at a predetermined distance from the sound source; and a plurality of lights positioned between the sound source and the viewing area, wherein each of the plurality of lights undergoes a visible change, sequentially, from the sound source to the viewing area when a sound wave is produced by the sound source. The rate at which the plurality of lights are visibly changed is substantially equal to the speed of sound such that the sound wave reaches the viewing area at substantially the same time that a light of the plurality of lights that is closest to the viewing area is visibly changed.

18 Claims, 10 Drawing Sheets

SPEED-OF-SOUND EXHIBIT

BACKGROUND OF THE INVENTION

1. Field of the Invention

This invention relates generally to a system for demonstrating the speed of sound.

2. Description of Related Art

The speed of sound waves traveling through air is significantly slower than the speed of light. The speed of sound is approximately 343 m/s and the speed of light is about 300,000 km/s. The speed of light is about 1 million times faster than the speed of sound.

During everyday life the difference between the speed of sound and the speed of light is not noticeable. The difference between when light reaches a person and the sound produced reaches the person cannot be noticed when the distance is short. However, there are occasionally situations in which the difference between the speed of sound and the speed of light becomes apparent. For example, during a thunder storm lighting is seen seconds before the sound caused by the lightning strike reaches the observer. An airplane may seem to be flying ahead of the sound of its engines.

While all of these phenomena demonstrate that sound does not travel at the same speed as light (which appears to be instantaneous), it is generally not possible to predict when such phenomena will occur. Attempts have been made to provide a demonstration of the speed of sound, however, most known demonstrations rely on a long line of people to demonstrate the phenomena. Such a demonstration, however, is inaccurate since the demonstration relies on the reaction of people to hearing a sound as it propagates toward an observer, which can vary from person to person. Furthermore, such a demonstration requires a significant amount of time and effort to set up, and will only be observable for a short period of time. It is therefore desirable to be able to provide an observable and accurate demonstration of the speed of sound that can be produced on demand.

SUMMARY OF THE INVENTION

A system for presenting a demonstration of the speed of sound, includes: a sound source that produces a sound wave; a viewing area positioned at a predetermined distance from the sound source; and a plurality of lights positioned between the sound source and the viewing area, wherein each of the plurality of lights undergoes a visible change, sequentially, from the sound source to the viewing area when a sound wave is produced by the sound source. The rate at which the plurality of lights are visibly changed is substantially equal to the speed of sound such that the sound wave reaches the viewing area at substantially the same time that a light of the plurality of lights that is closest to the viewing area is visibly changed. In some embodiments, the plurality of lights are positioned in a line between the sound source and the viewing area.

In some embodiments, the predetermined distance is at least about 150 meters. The sound source, therefore, should be capable of producing a sound wave that is audible at a distance of at least 150 meters.

In some embodiments, the viewing area includes an actuation device that is coupled to the sound source. Operating the actuation device causes the sound source to produce a sound wave.

In some embodiments, sound detectors are coupled to each of the plurality of lights. During use, each sound detector sends a signal to cause the light to visibly change when the sound wave reaches the sound detector. In an alternate embodiment, a controller is coupled to the plurality of lights. The controller activates the lights in a sequence at a rate approximately equal to the speed of sound when the sound wave is produced by the sound source. A combination of sound detectors and a controller may be used to activate the lights.

Different visible changes may be used to present a light wave to the user. A visible change may be turning the light source on (or off). Alternately, the visible change may be changing the color of the light source.

In one embodiment, a light source positioned proximate to the sound source. The light source is configured to produce a pulse of light substantially simultaneously with the production of the sound wave by the sound source.

In an embodiment, there is neither sound source nor sound. The visible changes in the plurality of lights demonstrates the speed of sound visually, without accompanying aural effects.

In an embodiment, a method of demonstrating the speed of sound uses a speed of sound demonstration system, as described above. The method includes: producing a sound wave by the sound source; visibly changing a plurality of lights sequentially, from the sound source toward the viewing area, after a sound wave is produced by the sound source. The rate at which the plurality of lights are visibly changed is substantially equal to the speed of sound such that the sound wave reaches the viewing area at substantially the same time that a light of the plurality of lights that is closest to the viewing area is visibly changed.

BRIEF DESCRIPTION OF THE DRAWINGS

Advantages of the present invention will become apparent to those skilled in the art with the benefit of the following detailed description of embodiments and upon reference to the accompanying drawings in which.

Figure 1:
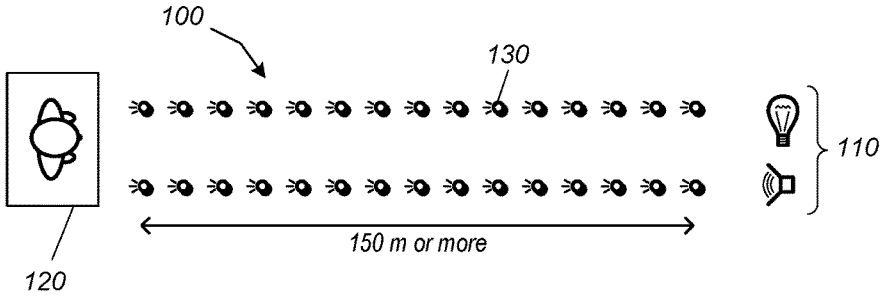
FIG. 1 depicts a first embodiment of a speed of sound demonstration system.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE INVENTION

It is to be understood the present invention is not limited to particular devices or methods, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected.

A system for presenting an observable demonstration of the speed of sound includes a sound source, capable of producing a sound wave and a viewing area. The viewing area is positioned at a predetermined distance from the light/sound source. In some embodiments the sound source is positioned at least about 150 m from the viewing area. A plurality of lights is positioned between the sound source and the viewing area. Each of the plurality of lights undergoes a visible change, sequentially, from the sound source to the viewing area when a sound wave is produced by the sound source. Specifically, the rate at which the plurality of lights are visibly changed is substantially equal to the speed of sound such that the sound wave reaches the viewing area at substantially the same time that a light of the plurality of lights that is closest to the viewing area is visibly changed.

In an embodiment, the demonstration is initiated when one or more observers enter the viewing area. Once the observer(s) are ready a signal is sent to the sound source and the sound source emits a sound pulse which creates a sound wave radiating from the sound source. The sound wave begins travelling toward the observer(s) in the viewing area at the speed of sound (about 343 m/s). As the sound wave passes the plurality of lights, each light will be visibly changed (turned on, changed color, etc.) to signal the passage of the sound wave past the light. Observer(s) in the viewing area will see the sequence of illuminating lights "heading toward" them. The moving transition point between, for example, the illuminated and unilluminated lights marks the location of the approaching sound wave. The sound wave then reaches the observer(s) in the viewing area at the same moment as the approaching transition point between the illuminated/unilluminated light reaches the viewing area. The observer(s) therefore hear the sound produced by the sound source when the lights "arrive" at the viewing area.

The basic system described above can be embellished in many different ways including, but not limited to: mechanical signaling devices used in place of lights; lights positioned in arrangements other than a linear arrangement; multiple sound sources and viewing areas; and using multicolored lights; using multi-toned sound sources. The system may also be used to present entertaining light and sound displays to the observer(s), instead of the speed of sound demonstration.

FIG. 1 depicts a first embodiment of a speed of sound demonstration system. The speed of sound demonstration system 100 includes a light and sound source 110 and a plurality of lights 130 positioned between the light and sound source 110 and viewing area 120. Lights are positioned horizontally, near the ground. It should be understood that, in FIG. 1, while two linear rows of lights are depicted, a single linear row of lights may be used, or more than two rows of lights may be placed between light and sound source 110 and viewing area 120.

During use, light and sound source 110 emits a brief sound (such as a pop or a bang) and, substantially simultaneously, produces a pulse of light. The sound produced by light and sound source 110 should be audible at a distance of at least the distance between the light and sound source and the viewing area. Typically, the sound will be audible for a distance of at least about 150 meters. Similarly, the light produced by light and sound source 110 should be visible at a distance of at least the distance between the light and sound source and the viewing area (e.g., at least about 150 m).

Once the sound wave is produced, it will travel towards the observer(s) at the speed of sound (343 m/s). If the distance between light and sound source 110 and viewing area 120 is about 350 m, the sound will take about one second to travel between the light and sound source and the viewing area. The lights 130 between viewing area 120 and light and sound source 110 light up (or flash or pulse) as the sound wave passes the lights. The observer(s) will perceive a sequence of lights progressing toward the observer(s) at the speed of sound. The lights 130 and sound wave track together all the way to the viewing area. The sound wave and the "light wave" will reach the viewing area at substantially the same time. In this way, the lights serve as a visual demonstration of the speed of sound.

As used in herein, the visual display of lights illuminated in a sequence so that the observer(s) see some coherent motion moving toward the observer(s) will be referred to as a "light wave." The leading edge of the light wave will be referred to as the "light wave front."

In an exemplary embodiment, the light and sound sources produce a sound in the form of a bang (similar to a firework going off) and a flash of light. The flash of light signals to the observer(s) in the viewing area that a sound has been produced. Since the time for light to travel to the observer(s), at the distances contemplated for this demonstration system, is instantaneous, the light will reach the viewing area well before the sound wave (the bang). After observing a flash of light at the light and sound source, the observer(s) will see a light wave lighting up in sequence such that the light wave front approaches the observer(s) at the speed of sound, and at the same time that the actual sound (the bang) is approaching the observer(s). The approaching light wave front of illuminating lights reaches the viewing area at substantially the same time as the sound wave.

In one embodiment, the lights may be implemented as any of several different types of lights. Examples of lights that could the used, in the plurality of lights include, but is not limited to: incandescent lights, arc lights, neon lights, fluorescent lights, xenon lights, light-emitting diodes (LED lights). The sound may be produced using any well-known speaker technologies. Alternatively, the sound may be produced mechanically (e.g., by having two objects hitting against each other).

In one embodiment, the components of the demonstration system (e.g., the light and sound source and each of the plurality of lights) are all interconnected into a network. The components may be interconnected through wired, wireless, or a combination of wired and wireless connections. Each of the components of the demonstration system may be connected to a master controller. The master controller can activate each of the components by sending a signal to each component to activate or deactivate as needed. In order to implement this type of control system, each component, including each of the plurality of lights, will need a unique electronic identifier that will allow the controller to direct control signals to the proper component. In an embodiment, the master controller activates the light and sound source, causing these components to produce light and sound. The master control then coordinates the activation of each individual light source to produce the visual light wave front that denotes the leading edge of the sound wave.

The network used to control activation of the components may be implemented using digital or analog communication. The network may operate using radio frequency communication, infrared, ultrasonics, wire, fiber optics, etc. The master controller may be implemented using as an advanced digital device, or a set of mechanical switches, that supply power to each component at the correct time to provide the desired optical effect.

In another embodiment, each light of the plurality of lights 130 is coupled to a sound detector. The sound detector detects the sound produced by the sound source and causes the light to, for example, turn on, substantially immediately when the sound is detected. The use of sound detector allows the demonstration system to adapt to the variability of the speed of sound due to temperature or humidity variations. Additionally, there is not a need for a "master controller" that coordinates the activation of the light sources. Finally, since each light acts individually, there is no need to create a unique electronic identifier for each light source.

Figure 2:
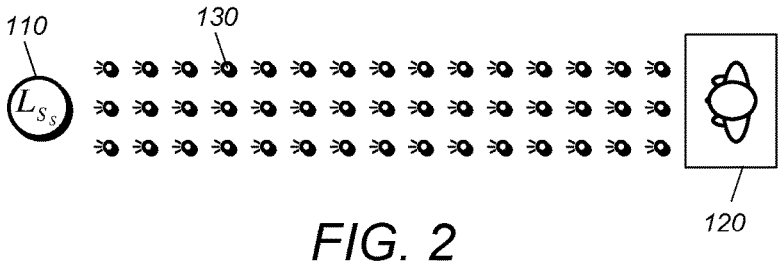
FIG. 2 depicts a speed of sound demonstration system that includes three rows of lights between the LSS and the viewing area.
Figure 3:
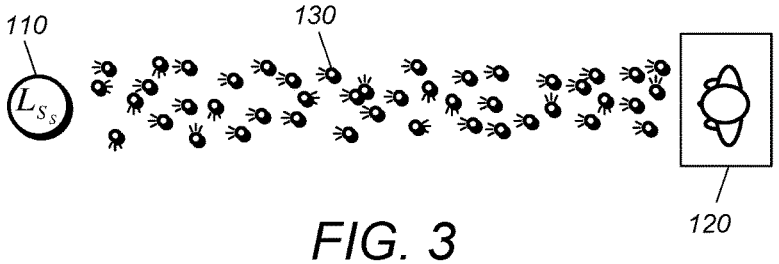
FIG. 3 depicts a speed of sound demonstration system that includes lights arrayed in an irregular pattern between the LSS and the viewing area.

FIG. 2 depicts an alternate embodiment, which is similar to FIG. 1, but includes three horizontally-aligned rows of lights 130 between the light and sound source (LSS) 110 and the viewing area 120. The lights do not have to be implemented in an ordered array, as depicted in FIGS. 1 and 2. FIG. 3 depicts an embodiment in which the lights 130 are arrayed in an irregular pattern. Like the previous embodiments, the lights in FIG. 3 will undergo a visible change, however the irregular arrangement of the lights will produce a different visual effect for the approach of the light wave front to the viewing area. Instead of a neat, straight light wave front, the irregularly arranged lights may produce an irregular light wave front approaching the observer(s) in the viewing area.

Figure 4:
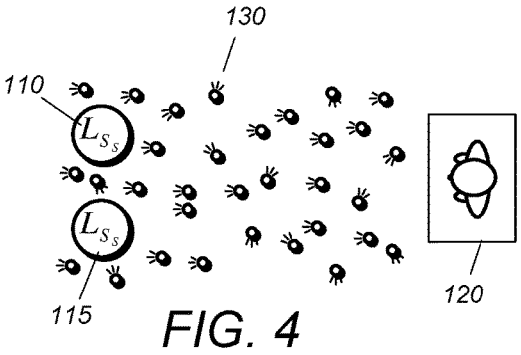
FIG. 4 depicts a speed of sound demonstration system that includes two different LSSs.
Figure 5:
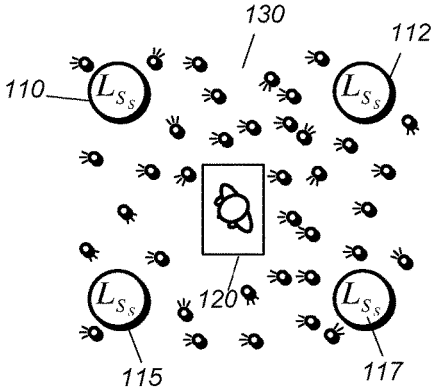
FIG. 5 depicts a speed of sound demonstration system that includes four different LSSs.

FIG. 4 depicts a demonstration system that is composed of two different light and sound sources, 110 and 115. Each LSS may be associated with different individual lights of the plurality of lights 130. In the configuration of FIG. 4, the LSSs are arranged in generally the same direction from the observer(s), allowing the observer(s) to watch two different visual light wave fronts approach viewing area 120. FIG. 5 depicts a demonstration system that is composed of four different light and sound sources, 110, 112, 115, and 117. In the configuration of FIG. 5, the viewing area may be placed in the center of a plurality of lights. This configuration may be used to prepare an optical effect of sound waves coming at the user from multiple directions.

Figure 6:
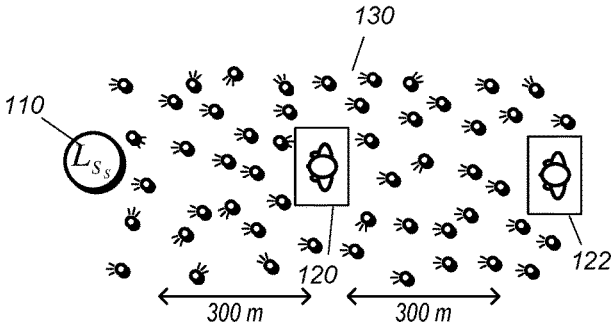
FIG. 6 depicts a speed of sound demonstration system that includes two different viewing areas.
Figure 7:
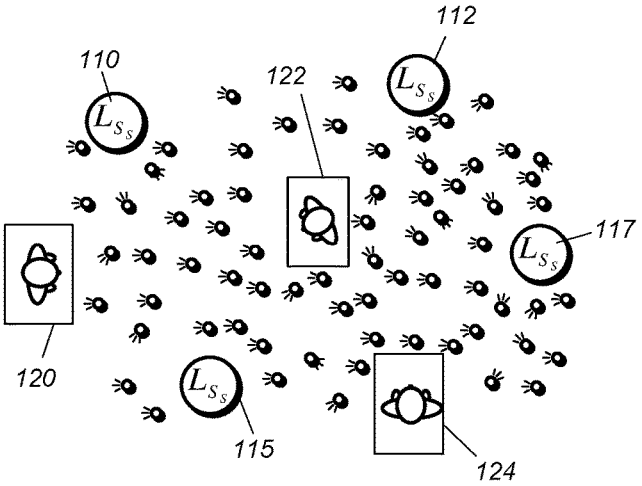
FIG. 7 depicts a speed of sound demonstration system that includes multiple viewing areas and multiple LSSs.

In some embodiments, there may be multiple viewing areas. For example, FIG. 6 depicts a demonstration system that includes an LSS 110 and two viewing areas 120 and 122. When in viewing area 120, the observer(s) will see a visual sound wave approaching at the speed of sound, passing by the observer(s), then heading away from the observer(s) toward second viewing area 122. The observer (s) at the second viewing area will see the sound wave approach the first viewing area, pass the first viewing area and continue up to the second viewing area. In a similar manner, the system of FIG. 7 produces a variety of unique viewing experiences for observer(s) at each of the viewing areas 120, 122, and 124.

As discussed herein, the basic demonstration provides a visual light wave front that approaches the observer(s) at the speed of sound. The simplest implementation is to simply turn on the lights as the actual sound wave passes the lights. The lights may remain on as the wave moves toward the observer(s), or, may briefly turn on, then off as the sound wave passes past the light. In an alternate embodiment, the lights may emit different colors (e.g., using multicolor LED lights). The use of multicolor lights can be used to create a more entertaining demonstration.

Figure 8:
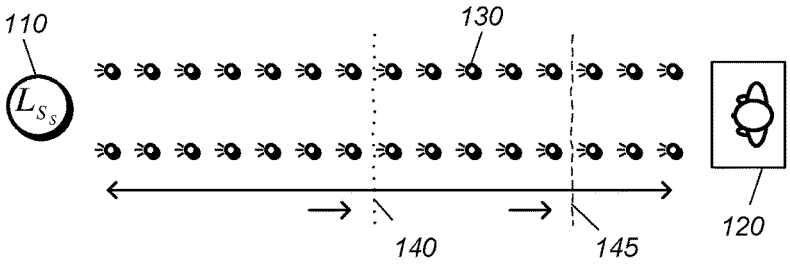
FIG. 8 depicts a speed of sound demonstration system that includes an LSS that produces multiple different sound waves.

In one embodiment, the lights of the plurality of lights may be capable of emitting different color lights, and the sound source can produce different tones. The color emitted by the light, as the soundwave travels past the light, can be linked to the sound produced. In this manner, each unique sound produced by the sound source can be associated with a unique color of the lights demonstrating the sound wave. In the embodiment depicted in FIG. 8, multiple sound waves (optionally having different tones) may be produced at light and sound source 110. The first sound wave 145 moves toward viewing area 120 and as the sound wave passes by the lights the lights are activated to produce a first color (e.g., red). Second sound wave 140 is subsequently produced (e.g., about ½ a sec after the first sound wave is produced) and travels to ward viewing area 120. As the second sound wave passes by the lights, the lights change to a second color (e.g. green). The result is that observer(s) at the viewing area

120 will see lights of the first color approaching the observer (s) with lights of a second color trailing the lights of the first color. When the first sound wave reaches the observer(s), the observer(s) will hear the first sound, but will also see the second sound wave approaching, as the lights change to the second color. When the second sound wave arrives at the viewing area, the observer(s) will hear the second sound.

The use of multiple different colors and multiple sound waves make a more dramatic presentation of the speed of sound. The above discussed examples could be elaborated by adding more colors, more sound pulses, sound pulses that vary in intensity (i.e., volume), sound pulses that vary in tone.

Multicolor lights may be implemented by using individual lights that are composed of three primary color LEDs (red, blue, and yellow). The color of each light can be altered by controlling which of the three LEDs is lighted and the intensity of each of the three LEDs. In another embodiment, each light position may be made of two or more lights that emit only a single, but different, color. For example, at each light position a light of a first color (e.g., white) is positioned next to a light having a second color (e.g., yellow).

In an embodiment, multi-color lights and multi-tone sound sources may be used to create various experiences. For example, the lights may emit a plurality of different colors at a plurality of different intensities. Similarly, the sound source may emit a variety of different sound tones and intensities. Color and brightness of a light's emitted light may correspond to the tone and intensity of the sound wave passing by the light. Overall, the effect is a multi-colored and polyphonic presentation.

With such large distances involved, the lights may need to have a high intensity. In some embodiments, a light focusing device may be coupled to the light. The light focusing device could help direct the light toward the viewing area.

There are multiple ways that the lights can be activated to identify a passing sound wave. In one embodiment, the light will briefly light up. Each light will come on for less than 0.1 sec. A Xenon flash lamp, for example, could be used as a light source that is briefly activated.

In another embodiment, each light stays on for a short time (less than a second) but for a time that is longer than the flash devices discussed above. In one embodiment, incandescent lights are used as the lights and the "short time" that the lights remain on is the time for the filament to heat (or cool, when turning off). In another embodiment, each light will turn on and stay on was the sound wave passes the light.

Figure 9:
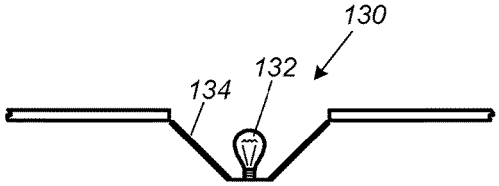
FIG. 9 depicts an embodiment of a light embedded in the ground.

There are several ways to position the lights relative to the ground. In one embodiment, depicted in FIG. 9, lights are embedded in the ground but still shine upward to be visible to observer(s) standing in the viewing area. As shown in FIG. 9 light 130, includes a light source 132 embedded in a reflective chamber 134. For example, sidewalls of reflective chamber 134 may be formed of mirrors (e.g., highly polished metal). The light source may be embedded anywhere from 5 inches to 20 inches below the surface of the ground.

Figure 10:
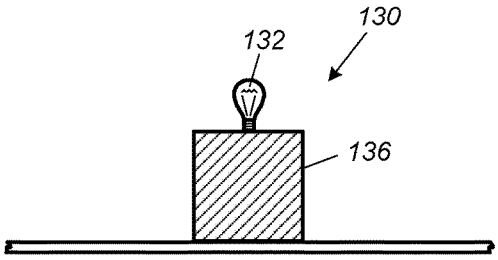
FIG. 10 depicts an elevated light.

In an alternate embodiment, the lights may be raised above ground layer. FIG. 10 depicts a raised light 130, that includes a light source 132 that is mounted to a raised support 136. The raised support, in some embodiments, may include control and communication components which allow the light to be controlled by a master controller. Alternatively, the raised support may include a sound detector, which switches the light on when a sound is detected by the sound detector. The light source may be raised anywhere from 5 inches to 20 inches above the surface of the ground.

Figure 11:
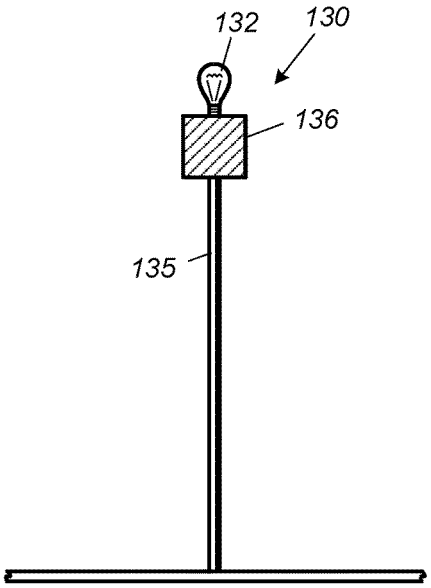
FIG. 11 depicts a light mounted to a post.
Figure 12:
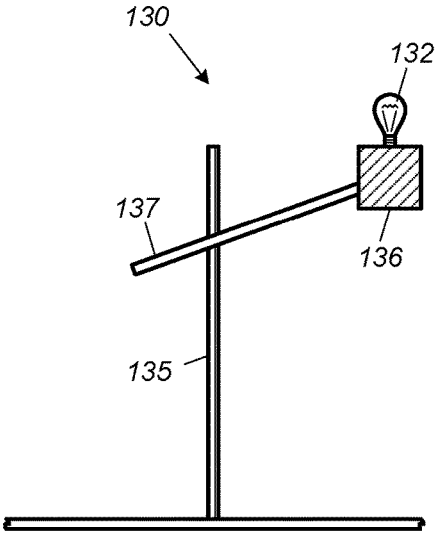
FIG. 12 depicts a light mounted to an articulated cross bar.

In another embodiment, the light source may be mounted to a post or support that elevates the light source to a height of at least 2 ft, preferably to a height of between 5 ft. and 15 ft. FIG. 11 depicts a light mounted to a post. Light 130 includes a light source 132 mounted to a controller box 136 which includes light control components that allow either control of the light by a master controller, or includes a sound detector which switches the light on when a sound is detected by the sound detector. The light source and controller box are then mounted to a post 135 which raises the height of the light source above about 2 ft. FIG. 12 depicts a variation of the raised light source that includes a post 135 and an articulated cross bar 137 which can be used to vary the height of the light source 132. In an embodiment, the height of the light source can be varied from a height of 2 ft. up to 15 ft.

Figure 13:
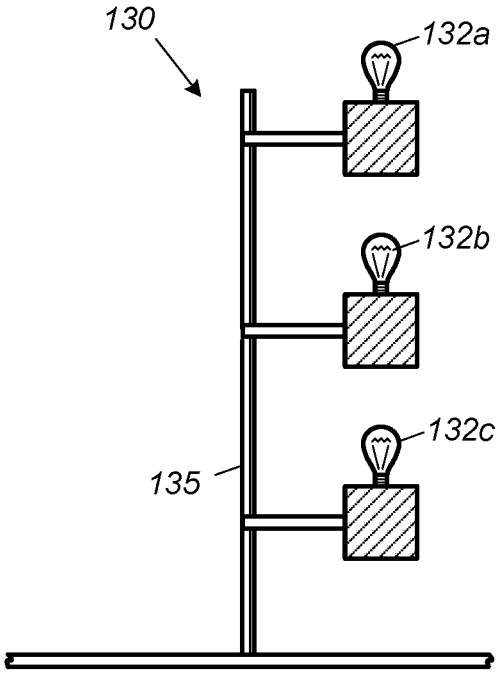
FIG. 13 depicts a plurality of lights mounted to a post.

In another embodiment, each light 130 may include multiple light sources 132*a*, 132*b*, and 132*c* mounted to a post 135. As depicted in FIG. 13, each light source is at a different height from the ground. It should be understood however, that each light source may be mounted at the same height, around the perimeter of the post. Light sources 132*a*, 132*b*, and 132*c* may be the same color and/or intensity, or each light source may be a different color and/or intensity.

It should also be understood, that the above description, while describing the lights 130 that are disposed between the sound source and the viewing area, can also be applied to the sound source or both the light and sound source components.

Figure 14:
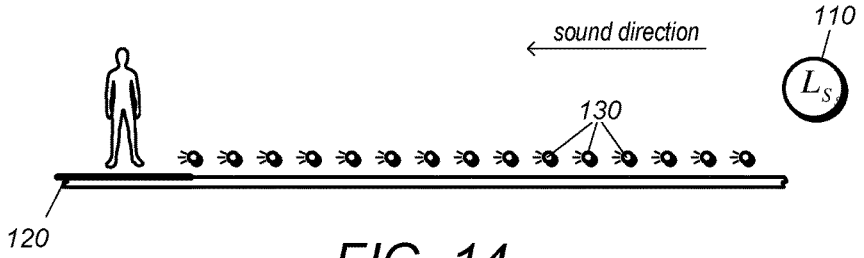
FIG. 14 depicts a speed of sound demonstration system that includes lights mounted at ground level.
Figure 15:
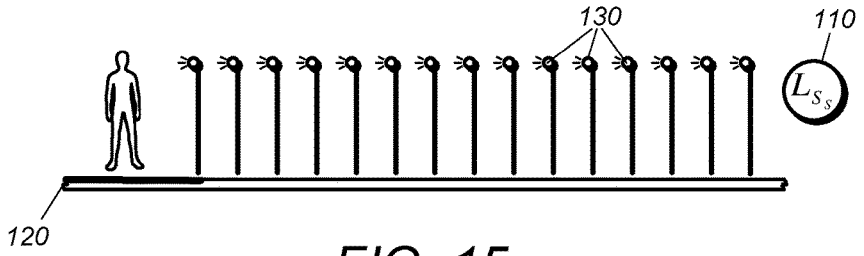
FIG. 15 depicts a speed of sound demonstration system that includes lights mounted on posts.

In addition to variations in lighting and sounds, ground level and viewing angle can also be altered to enhance the visual display. In FIG. 14, shown in elevation view, a viewing area 120 is disposed on the same level as the lights 130. Lights 130 may be substantially at ground level between the LSS 110 and the viewing area 120. Thus, the lights will appear to be running along the ground toward the observer(s) during the demonstration. FIG. 15 depicts a similar embodiment to FIG. 14. The configuration shown in FIG. 15 depicts lights 130 that are elevated above the ground level (such as lights shown in FIGS. 11-13), giving the sensation that the lights are coming right at the observer's head or body.

Figure 16:
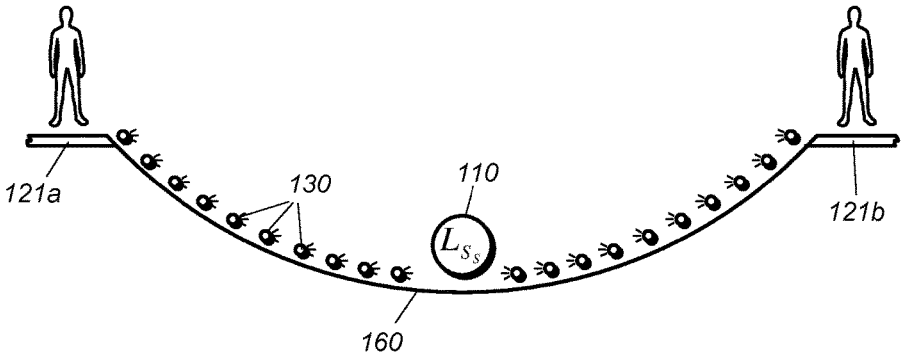
FIG. 16 depicts a speed of sound demonstration system that includes lights mounted in a basin.

In another embodiment, the LSS 110 may be placed in the center of a large basin shaped area, as depicted in FIG. 16, in elevation view. Basin 160, in some embodiments, has a diameter that is at least about 700 m. During use, LSS 110 produces a sound wave and light pulse. The sound wave and light pulse can be produced such that both the light and the sound radiate outward from the center of the basin. Observing stations 121*a* and 121*b* can be positioned anywhere along the basin 160 to view the demonstration. Such a configuration may be particularly suited for use in a sports stadium (e.g., a football stadium).

Figure 17:
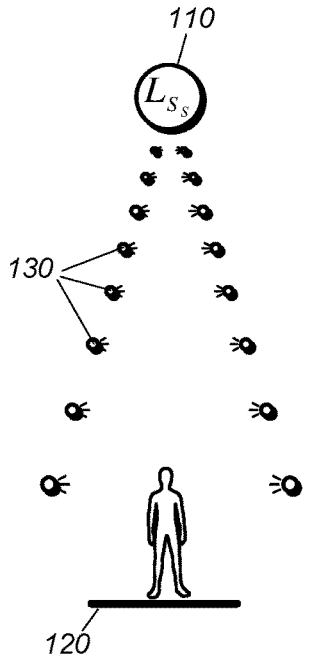
FIG. 17 depicts a speed of sound demonstration system as perceived by an observer.

Because of the distances involved, perspective effects can distort the appearance of the display, as viewed by the observer(s). FIG. 17 depicts how the system of FIG. 1 may appear to a user standing in a viewing area. Perspective effects cause the distant lights to visually "clump together", as perceived by the observer(s), while nearby lights appear to be spaced further apart, as depicted in FIG. 17, despite the fact that the lights are actually all spaced at equal distances. The visually wide spacing perceived for the nearby lights may make it difficult for the user to perceive the exact location of the second light front as the light front gets close to the observer(s). In particular, the observer(s) perceive the sound pulse as a wave of illumination approaching the observer(s). However, if the lights are spaced too far apart in the observer(s) visual field, the observer(s) may not perceive a sufficiently exact position of the light wave, that is approaching the observer(s).

Figure 18:
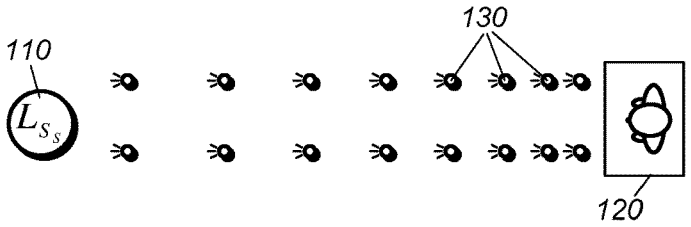
FIG. 18 depicts a speed of sound demonstration system that includes an ordered array of lights with a higher density of lights proximate to the viewing area.

Using a non-uniform distribution of the lights can be used to overcome the perspective effects. FIG. 18 depicts an embodiment that uses a non-uniform distribution of lights. As discussed with regard to FIG. 17, in a perspective view, the lights closest to the user appear to be spaced further apart, while lights far from the observer(s) appear to be closer to each other. In FIG. 18, the lights closest to the observer(s) are closely spaced to counter the perspective effect of making the lights appear to be further apart. Similarly, the light far away from the observer(s) are spaced further from each other to overcome the perceived closely spaced lights.

Figure 19:
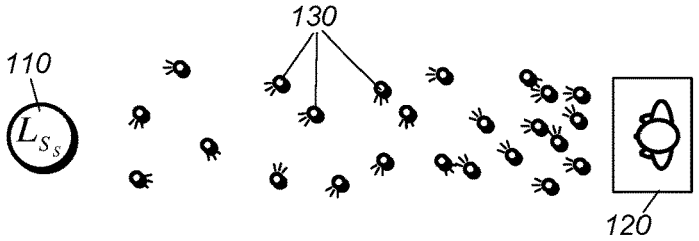
FIG. 19 depicts a speed of sound demonstration system that includes an irregular layout of lights with a higher density of lights proximate to the viewing area.

In FIG. 19, the lights 130 may be arranged in an irregular layout in which a dense distribution of lights are placed closer to the observer(s), with the lights becoming less dense closer to the LSS 110.

It should be understood that it is possible, in some embodiments, that the perspective effects will have little effect on the observer's experience, since the speed of sound wave may be too fast to perceive when it is very near the observer(s).

In another embedment, the lights may be implemented as one or more continuous lighting elements. The continuous lighting elements support varying light intensities or colors at a plurality of points along the length of the light source, to create a light wave effect.

It is a well-known phenomenon that a sound wave will lose intensity (i.e., sound pressure, measured as decibels, will decrease) as it travels over a long distance. In one embodiment, the intensity and/or color of the lights of a display system can be used to reflect this property of the sound wave. For example, lights may have an intensity that is greater closer to the source of the sound, and gradually become less intense as the light wave front approaches the user. Alternatively, the color of the lights can change as the intensity of the sound wave decreases. The intensity of light produced from light sources will also decrease over a distance. This may cause the lights that are furthest from the observer(s) to appear less bright than they actually are. It may be necessary to modify the intensity of the lights to also take into account the drop in light intensity as the light travels toward the observer(s).

Figure 20:
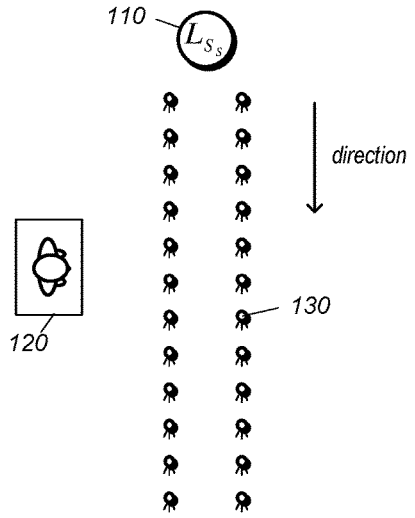
FIG. 20 depicts a speed of sound demonstration system that creates a light wave that is orthogonal to viewing area.

An alternate way to view the lights is to arrange the lights so that the light wave travels orthogonal to the position and viewpoint of the observer(s). FIG. 20 depicts a demonstration system that creates a light wave that is orthogonal to viewing area 120. In this embodiment, a sound and light are produced by LSS 110 and the lights 130 are lit sequentially to form a light wave that travels away from LSS 110. In this embodiment, each of the individual lights are roughly the same distance from the each other since the light intensity fall off, discussed above, is much less noticeable with the observer(s) off to the side. The orthogonal positioning of the lights, with respect to the observer(s), will still convey a sense of the speed of sound, but will be less dramatic or intuitive then the other methods. The demonstration system of FIG. 20 is particularly useful where loud sounds may be restricted. Under such circumstances the LSS can be replaced by a simple light system that only produces a light pulse when the demonstration is initiated. The observer(s) will then see a flash of light at the start of the demonstration, followed by a light wave travelling away from the light source.

Figure 21:
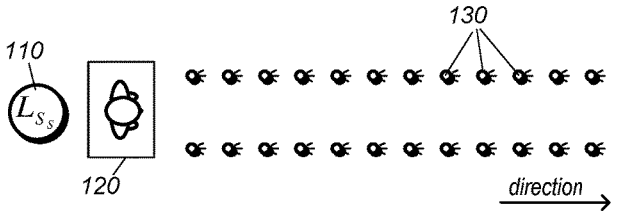
FIG. 21 depicts a speed of sound demonstration system that creates a light wave that moves away from the viewing area.

While most of the embodiments described herein have produce a light wave that travels toward the observer(s), it should be understood that the systems described herein may be modified such that the light wave moves away from the observer(s). FIG. 21 depicts a demonstration system where the light wave will appear to move away from the observer (s). The demonstration system includes a LSS that is position proximate to the observer(s). When initiated, the LSS will produce a light pulse and sound wave, although the intensity of both will be significantly reduced compared to an LSS that is positioned far away from the observer(s). A light wave is then produced which travels away from the observer(s) giving the observer(s) an impression of how fast sound travels away from the observer(s).

Figure 22:
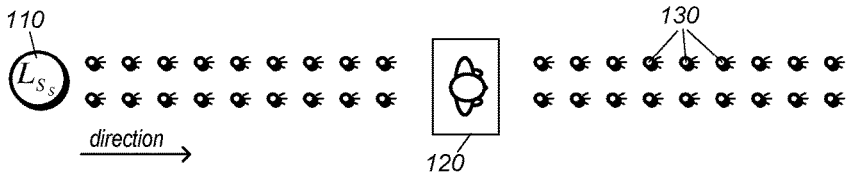
FIG. 22 depicts a speed of sound demonstration system that has a viewing area placed within a linear array of lights.

FIG. 22 depicts an alternate embodiment in which the viewing area 120 is placed in the line of the lights 130. LSS 100 is placed at one end of the linear array of lights. LSS will then produce a light pulse and sound wave which will travel toward an observer(s) in viewing area 120. The observer(s) will therefore see the light wave approaching from the LSS, pass through the observer(s), then continue on past the observer(s).

Lights do not have to turn "on" to mark/identify the passage of the sound wave. Any visible transition can be used. For example, the light could change color, instead of just turning on. The light could also go from on to off when a sound wave passes by.

Figure 23:
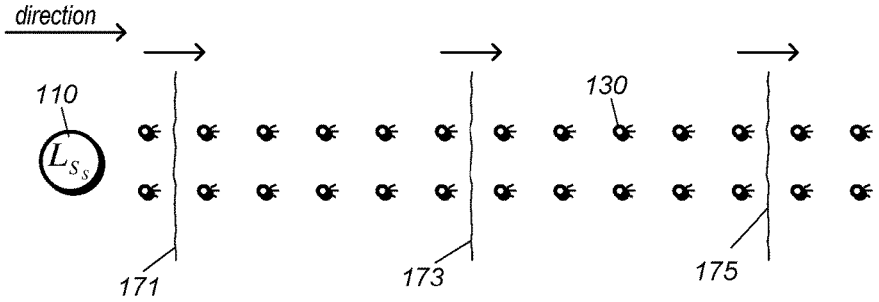
FIG. 23 depicts a speed of sound demonstration system that creates multiple sound and light waves.

In one embodiment, multiple sound waves can be sent from the LSS toward the user, each sound wave having a different effect on the lights. FIG. 23 depicts a demonstration system that includes LSS 110 and an array of lights 130. In the embodiment shown, three sound waves (171, 173, and 175) were created by the LSS and are expanding outward from the LSS toward an observer(s) (not shown). Prior to the production of sound waves, the lights 130 are off. When the first sound wave 175 reaches the lights, the lights turn on, creating a first light wave front. When the second sound wave 173 reaches the lights (now on from the passage of the first sound wave) the lights are turned off. When a third sound wave is produced, the lights (which are off from the passage of the second sound wave) turn back on as the third sound wave 171 passes the lights. This alternating pattern can be continued for as many sound wanes as are produced. An advantage of such a system is that the system does not have to be reset. The system will always be ready to demonstrate. While the description of this embodiment describes turning lights on and off, the system may alternatively be configured to change the lights to a different color as each sound wave passes by the light.

While all embodiments have been described as using lights, in alternate embodiments mechanical signaling devices may be used in place of, or in combination with, lights. For example, mechanical devices such as a device that can raise a flag, move an object, mechanically expose a new color to a user, create a puff of smoke, spray water, etc.

The distance between the viewing area and the LSS can be varied depending on the situation and area where the demonstration will be staged. The speed of sound is approximately 344 m/s at 20 C. At this rate, the demonstration system will need to be long enough for the observer(s) to be able to perceive the movement of the sound wave. Based on typical human perception the minimum distance between the viewing area and the LSS is about 30 m. The maximum distance is limited to the distance that the sound and light produced by the LSS can be seen and/or heard.

Figure 24:
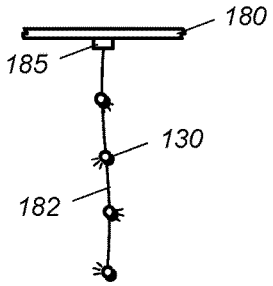
FIG. 24 depicts a lighting system suspended from a surface.
Figure 25:
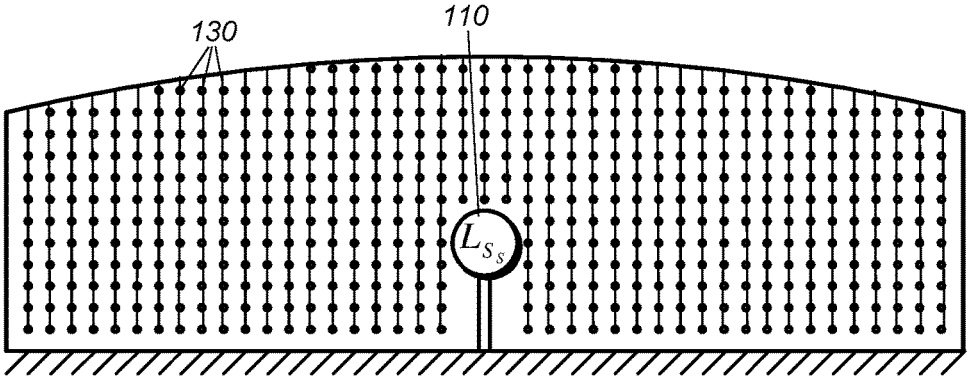
FIG. 25 depicts a speed of sound demonstration system that includes lights suspended from the ceiling.

In the previous embodiments, the lights are generally arranged in linear or two-dimensional arrays, typically at or near ground level. In alternate embodiments, it the lights can hang from an elevated surface 180 (e.g., a ceiling of a building). FIG. 24 depicts a lighting system 130 suspended from a surface 180. A mount 185 connects a cable 182 holding lights 130 to the elevated surface. Using such a system would allow a demonstration system to be built that is set up in a large 3D volume. For example, the demonstration may be set up in a large enclosed space such as a covered sports arena or airplane hangar. FIG. 25 depicts a cross-section view of a large enclosed area (e.g., a sports arena) having a plurality of ceiling mounted lights 130 filling the upper, generally empty, volume of the enclosed space. An LSS 110 is disposed in the middle of the volume of lights. Alternatively, the LSS may be positioned on one side of the structure. During use, the LSS will produce sound and light which will radiate from the LSS throughout the enclosed structure. Assuming the enclosed structure is sufficiently large, the observer(s), seated in chair around the circumference of the space, will see a light wave approaching them from the center of the enclosed space and will perceive the sound as the light wave reaches them.

In the demonstration systems described herein, lights may depict the "length" of a sound pulse. For example, if the LSS emits a tone of about 0.044 seconds, the sound pulse will be heard for about 0.044 seconds. This will correspond to a light wave front that has a light wave leading edge that is about 50 ft from the trailing edge of the light wave. Thus, the observer(s) will see a 50 foot segment of light moving toward the observer(s) at the speed of sound.

Every possible combination of these features has not been explicitly described, however, it should be understood that any features from one or more of the above-described exhibits can be described with any of the other embodiments. Furthermore, none of the demonstrations are limited to a single type of light. Mixtures of different lights (colored-white-yellow) or even mixtures of mechanical and lighting devices are also contemplated.

In one embodiment, the demonstration system is set up as part of a science museum exhibit. For example, the demonstration system may be placed in a park or the grounds surrounding the museum. In such a system sounds from the LSS may need to be loud, so it may not be feasible to have the system in constant operation. The operation of the system may be limited by allowing the LSS to emit just a few sound pulses once every hour (or 30 min, or 15 min.). Alternatively, the LSS will only emit sound when an observer presses an activation device. The activation device may be configured to limit activation of the device to every 10 minutes (or 20 minutes, or 30 minutes).

In another embodiment, an entertainment promoter sets up an installation of lights and LSS devices in a sports stadium or large open space. The promoter schedules several shows involving the system, with each show featuring various demonstrations of the speed of sound. The shows may also include dramatic, aesthetic, and entertaining light and sound displays. The demonstration system may also include music or be part of a musical performance.

In other embodiments, lamps may be mounted on Unmanned Aerial Vehicles (a.k.a. UAVs, a.k.a. drones) instead of being affixed to the ground or support structures. In these cases, UAVs may hover in locations discussed above. For example, in FIG. 11 or FIG. 12, a lamp may be mounted on a hovering UAV instead of on the depicted post or support structure. Similarly, multiple UAVs may support lamps in the same positions shown in FIG. 13 or FIG. 15, but without the need for a stationary support structure. A large number of UAVs—with attached lamps—may fill a large volume as depicted in FIG. 25, but without supporting cables. In other embodiments, one or more LSSs may be mounted on UAVs. In all these embodiments involving UAVs, the UAVs may hover in a stationary position during the speed-of-sound demonstration, or they may be in motion. In cases where the UAVs are in motion, they will still illuminate with proper timing, sequencing, and positioning so as to depict the progression of a sound wave through the demonstration area or volume.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A system for presenting a demonstration of the speed of sound, comprising:

a sound source that produces a sound wave;

a viewing area positioned at a predetermined distance from the sound source; and a plurality of lights positioned between the sound source and the viewing area;

one or more controllers coupled to the plurality of lights, wherein the one or more controllers activate each of the plurality of lights, such that each of the plurality of lights undergoes a visible change, sequentially, from the sound source to the viewing area when a sound wave is produced by the sound source;

wherein the rate at which the plurality of lights are visibly changed is substantially equal to the speed of sound such that the sound wave reaches the viewing area at substantially the same time that a light of the plurality of lights that is closest to the viewing area is visibly changed.

2. The system of claim 1, wherein the predetermined distance is at least about 150 meters.

3. The system of claim 1, wherein the sound source produces a sound wave that is audible at a distance of at least 150 meters.

4. The system of claim 1, wherein the viewing area comprises an actuation device that is coupled to the sound source, wherein, during use, operating the actuation device causes the sound source to produce a sound wave.

5. The system of claim 1, wherein the plurality of lights are positioned in a line between the sound source and the viewing area.

6. The system of claim 1, further comprising sound detectors coupled to the one or more controllers, wherein, during use, each sound detector sends a signal to the controller when the sound wave reaches the sound detector.

7. The system of claim 1, wherein the visible change is turning the light source on.

8. The system of claim 1, wherein the visible change is changing the color of the light source.

9. The system of claim 1, further comprising a light source positioned proximate to the sound source, wherein the light source is configured to produce a pulse of light substantially simultaneously with the production of the sound wave by the sound source.

10. A method of demonstrating the speed of sound using a speed of sound demonstration system, the speed of sound demonstration system, comprising:

a sound source that produces a sound wave;

a viewing area positioned at a predetermined distance from the sound source;

a plurality of lights positioned between the sound source and the viewing area, and one or more controllers coupled to the plurality of lights, wherein the one or more controllers activate each of the plurality of lights;

the method comprising:

producing a sound wave by the sound source; and sending a signal from the one or more controllers to each of the plurality of lights to visibly change a plurality of lights sequentially, from the sound source toward the viewing area, after a sound wave is produced by the sound source;

wherein the rate at which the plurality of lights are visibly changed is substantially equal to the speed of sound such that the sound wave reaches the viewing area at substantially the same time that a light of the plurality of lights that is closest to the viewing area is visibly changed.

11. The method of claim 10, wherein the predetermined distance is at least about 150 meters.

12. The method of claim 10, wherein the sound source produces a sound wave that is audible at a distance of at least 150 meters.

13. The method of claim 10, wherein the viewing area comprises an actuation device that is coupled to the sound source, and wherein the method further comprises operating the actuation device to causes the sound source to produce a sound wave.

14. The method of claim 10, wherein the plurality of lights are positioned in a line between the sound source and the viewing area.

15. The method of claim 10, wherein sound detectors are coupled the one or more controllers, and wherein each sound detector sends a signal to the controller when the sound wave reaches the sound detector.

16. The method of claim 10, wherein the visible change is turning the light source on.

17. The method of claim 10, wherein the visible change is changing the color of the light source.

18. The method of claim 10, wherein the speed of sound demonstration system further comprises a light source positioned proximate to the sound source, wherein the light source is configured to produce a pulse of light substantially simultaneously with the production of the sound wave by the sound source.

* * * * *